US005946959A

United States Patent [19]

Anderheyden et al.

[11] Patent Number: 5,946,959

[45] Date of Patent: Sep. 7, 1999

[54] PROCESS FOR PRODUCING ANNULAR WORKPIECES FROM METAL WITH A PROFILED CROSS SECTION AND A ROLLING FACILITY FOR CARRYING OUT THE METHOD

[75] Inventors: Klaus-Peter Anderheyden, Schwerte; Frank Siewert, Dortmund, both of Germany

[73] Assignee: WDB Ringwalztechnik GmbH, Witten, Germany

[21] Appl. No.: 08/953,000

[22] PCT Filed: May 25, 1996

[86] PCT No.: PCT/EP96/02261

§ 371 Date: Dec. 17, 1997

§ 102(e) Date: Dec. 17, 1997

[87] PCT Pub. No.: WO96/38241

PCT Pub. Date: Dec. 5, 1996

[30] Foreign Application Priority Data

May 30, 1995 [DE] Germany ..... 195 19 142
Jul. 15, 1995 [DE] Germany ..... 195 25 868

[51] Int. Cl.[6] ..... B21H 5/02

[52] U.S. Cl. ..... 72/84; 72/91

[58] Field of Search ..... 72/84, 67, 85, 72/91, 110

[56] References Cited

U.S. PATENT DOCUMENTS 1,986,072 1/1935 Schlaa ..... 72/91
3,611,771 10/1971 Ulrych ..... 72/84
3,822,574 7/1974 Krupin et al. ..... 72/110
4,173,877 11/1979 Kreiskorte ..... 72/107
4,291,559 9/1981 Martin ..... 72/110

FOREIGN PATENT DOCUMENTS 25 04 969 8/1976 Germany ..... 72/91

*Primary Examiner*—Lowell A. Larson
*Attorney, Agent, or Firm*—Herbert Dubno; Andrew Wilford

[57] ABSTRACT

External teeth are formed on an annular metallic workpiece centered on a workpiece axis by fitting the annular metallic workpiece to a die with internally directed teeth to form axially open and radially closed spaces between the workpiece and the die at the teeth and axially pressing a pair of closing members oppositely against the die and workpiece to axially close the spaces. Then the fitted-together die, closing members, and workpiece are engaged between a pair of tools that are pressed together along a pressing axis generally parallel to the workpiece axis. The die, members and workpiece are synchronously rotated about the workpiece axis while the tools are rotated about respective tool axes each forming a small acute angle with the workpiece axis so as to locally compress the workpiece axially between the tools to deform the workpiece into the spaces. A bearing supports the die and workpiece while the workpiece is compressed between the tools.

12 Claims, 4 Drawing Sheets

PROCESS FOR PRODUCING ANNULAR WORKPIECES FROM METAL WITH A PROFILED CROSS SECTION AND A ROLLING FACILITY FOR CARRYING OUT THE METHOD

CROSS REFERENCE TO RELATED APPLICATIONS

This application is the US national phase of PCT application PCT/EP96/02261 filed May 25, 1996 with a claim to the priority of German applications 195 19 142.0 filed May 30, 1995 and 195 25 868.1 filed Jul. 15, 1995.

FIELD OF THE INVENTION

This invention relates to a method of making annular workpieces of metal, preferably steel with a profiled section and preferably with external angled teeth, wherein, starting from a blank whose outer diameter corresponds generally to the foot diameter of the teeth, the workpiece is forced to flow radially into a toothed die that forms together with a closing device a closed space and whereby the depth of the die corresponds to the tooth width. This invention also relates to an apparatus for carrying out the method.

BACKGROUND OF THE INVENTION

A method is known from German 3,718,884 wherein the workpieces are deformed purely by pressing. The large contact surfaces here subject the die to considerable wear which affects its service life (elastic deformation, bending, cracking). As a result it is necessary to prestress the die in an expensive setup. In addition with this pressing the necessary working procedures such as loading, knocking out, pivoting out, cleaning, lubricating, and cooling can only be done one after the other. This results naturally in a very long cycle time.

A method is known from German patent document 2,611,568 for producing annular workpieces with heavily profiled sections as well as a rolling facility for carrying out the method, with two oppositely movable and relatively angled rollers of which at least one which is a negative of the desired rolled profile is driven. With this so-called axial forging rolling (AFR) there is no way to produce an external or edge toothing and there is naturally no toothed die.

OBJECT OF THE INVENTION

It is an object of the invention to provide a method of the described type and an apparatus for carrying out the method wherein the high loads created during pressing are avoided and the cycle time can be increased.

SUMMARY OF THE INVENTION

This object is attained according to the invention in a system for forming external teeth on an annular metallic workpiece centered on a workpiece axis wherein the annular metallic workpiece is fitted to a die with internally directed teeth to form axially open and radially closed spaces between the workpiece and the die at the teeth and a pair of closing members are pressed axially oppositely against the die and workpiece to axially close the spaces. Then the fitted-together die, closing members, and workpiece are engaged between a pair of tools that are pressed together along a pressing axis generally parallel to the workpiece axis. The die, members and workpiece are synchronously rotated about the workpiece axis while the tools are rotated about respective tool axes each forming a small acute angle with the workpiece axis so as to locally compress the workpiece axially between the tools to deform the workpiece into the spaces. A bearing supports the die and workpiece while the workpiece is compressed between the tools.

The inventive use of the AFR method with opposite inclined tools to produce annular workpieces with outer or edge teeth makes it possible that on rolling only a portion of the annular surface of the workpiece is acted on so that relatively small pressing forces can be used. The teeth are produced in that the material is forced to flow radially into the toothed, independently journaled, and also rotating die. The tool profile does not contribute to the shaping of the teeth. The die is handled independently of the two rotating tools. It can according to the invention be fitted outside the pressing station with the blank of the workpiece and then transported between the two separated tools and, once the pressing operation is over and the tools have been retracted, it is taken together with the completed workpiece out of the working region of the rollers. It has been shown according to the invention as particularly advantageous to mount the die rotatably in an axially fixed journal and to arrange the journal on the pivot arm of a pivotal support so that the die can be moved by a simple pivotal movement into and out of the pressing station. It is preferable to provide three pivotal arms equiangularly about the support so that simultaneously at three different stations the procedures of pressing, loading, and unloading the workpiece as well as in addition maintenance procedures, cleaning, lubricating, and cooling can take place. By separating these operations the cycling time can be substantially reduced since in particular the loading and unloading do not have to take place right n the deforming station. The actual pressing station thus is of substantially simpler construction so that in addition knocking the finished workpiece out does not have to be done right in the pressing station. In addition since only a part of the workpiece ring is being deformed at one time, much less force is needed to force the workpiece radially into the die.

A further advantage of the method according to the invention is that through simple changing of the symmetry relationships at the tools various even asymmetrical cross sections can be produced in the workpiece. Changing the simply manufactured die can change the type of teeth in a simple manner.

BRIEF DESCRIPTION OF THE DRAWING

The invention is more closely described in attached FIGS. 1 through 4 by way of example.

SPECIFIC DESCRIPTION

Figure 1:
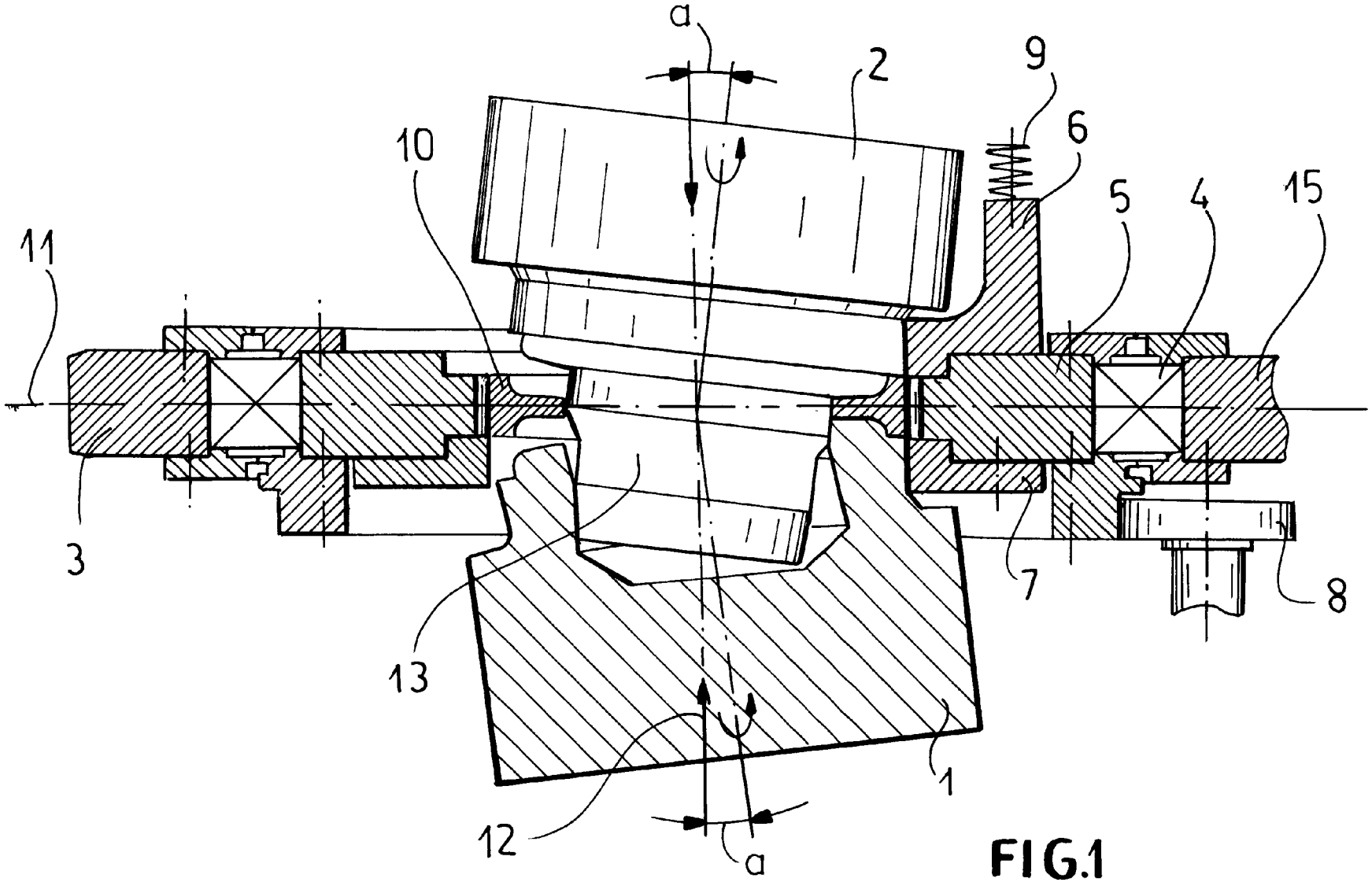
FIG. 1 is a section through the pressing station according to the invention.

According to FIG. 1 two tools 1 and 2 are each inclined at an angle $\alpha$ relative to the pressing direction 12 while the axial symmetry line 11 of the workpiece 10 extends perpendicular to the pressing direction 12. The workpiece 10 is held in the die 5 that also is rotatably mounted via the roller bearing 4 in the end 3 of the pivot arm 15. The tooth gaps of the die are axially upwardly and downwardly closed by the two closing devices 6 and 7, the lower being fixed relative to the die 5 and the upper being elastically mounted via the spring 9 with the upper tool 2 and taken off after pressing with same. The deformation of the workpiece 10 is determined by the shape of the tools 1 and 2 that are moved together in the pressing direction 12 until the final shape of the workpiece 10 is obtained and in particular the workpiece flows radially into the spaces of the die 5. The upper tool 2 has on its end a cylinder-shaped pin 13 that extends into a corresponding recess of the lower tool 1 and is guided there.

Figure 2:
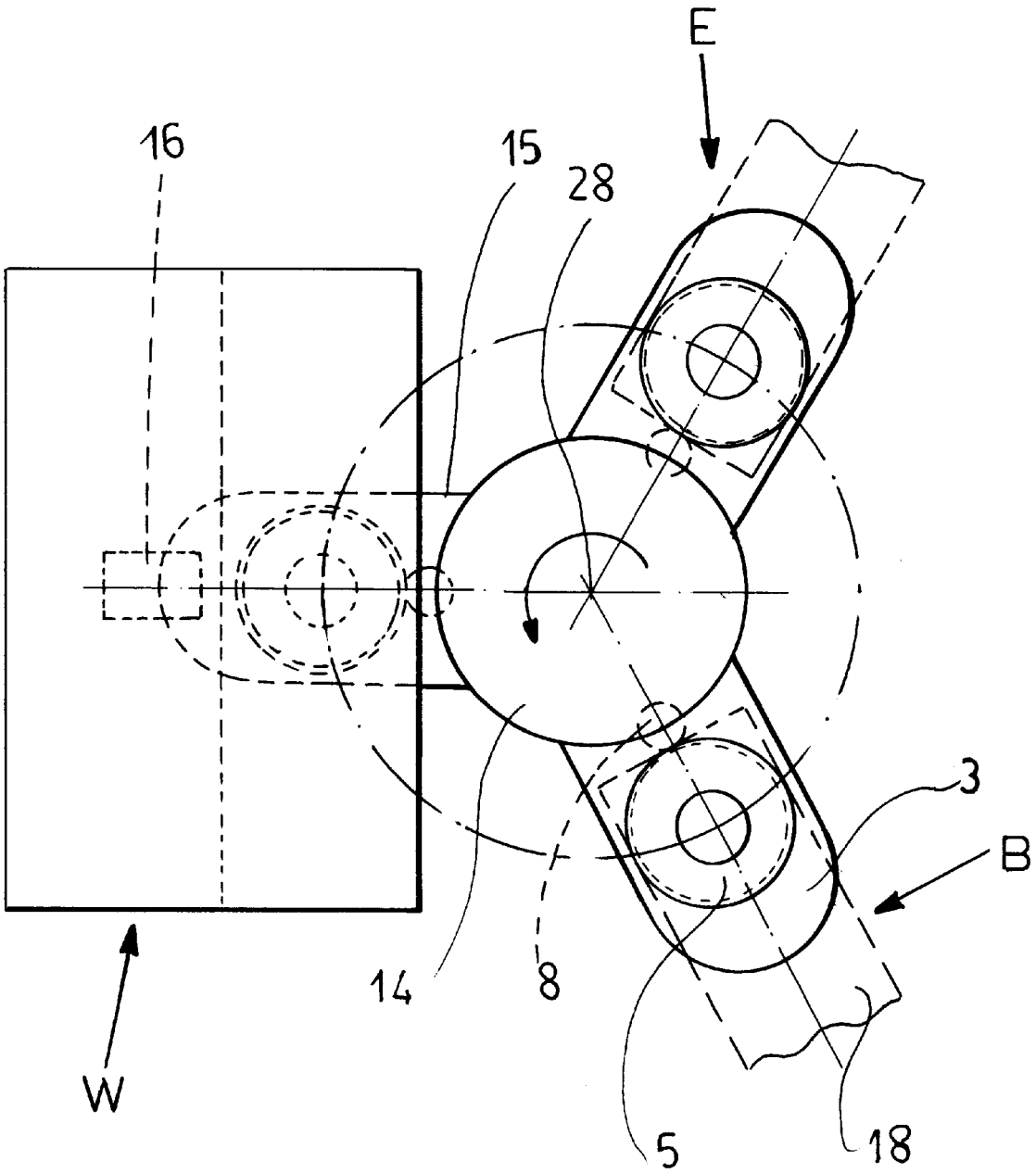
FIG. 2 is a schematic top view of an arrangement of three stations for pressing (W), unloading (E), and loading (B)
Figure 3:
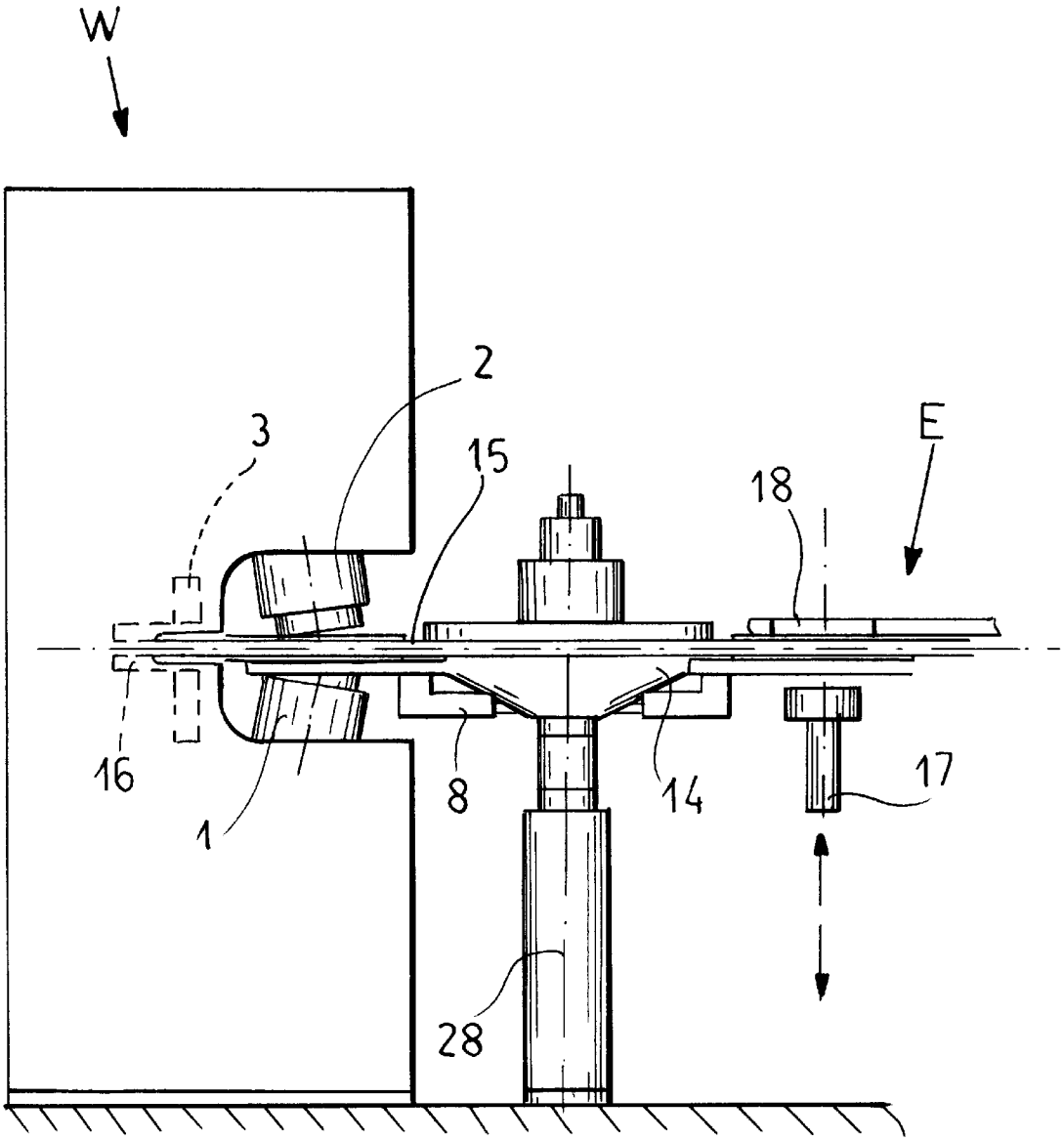
FIG. 3 is a side view of FIG. 2.

FIGS. 2 and 3 show the pressing station W according to FIG. 1 schematically, a pivot arm 15 of the support 14 being arranged in the pressing station and held there by a clamping device 16. The two further pivot arms 15 are in the unloading station E and the loading station B. Above and below the pivot arms there are holding plates 18 that grip the die 5 when the workpiece is removed with the knock-out device 17 and a sliding device.

Figure 4:
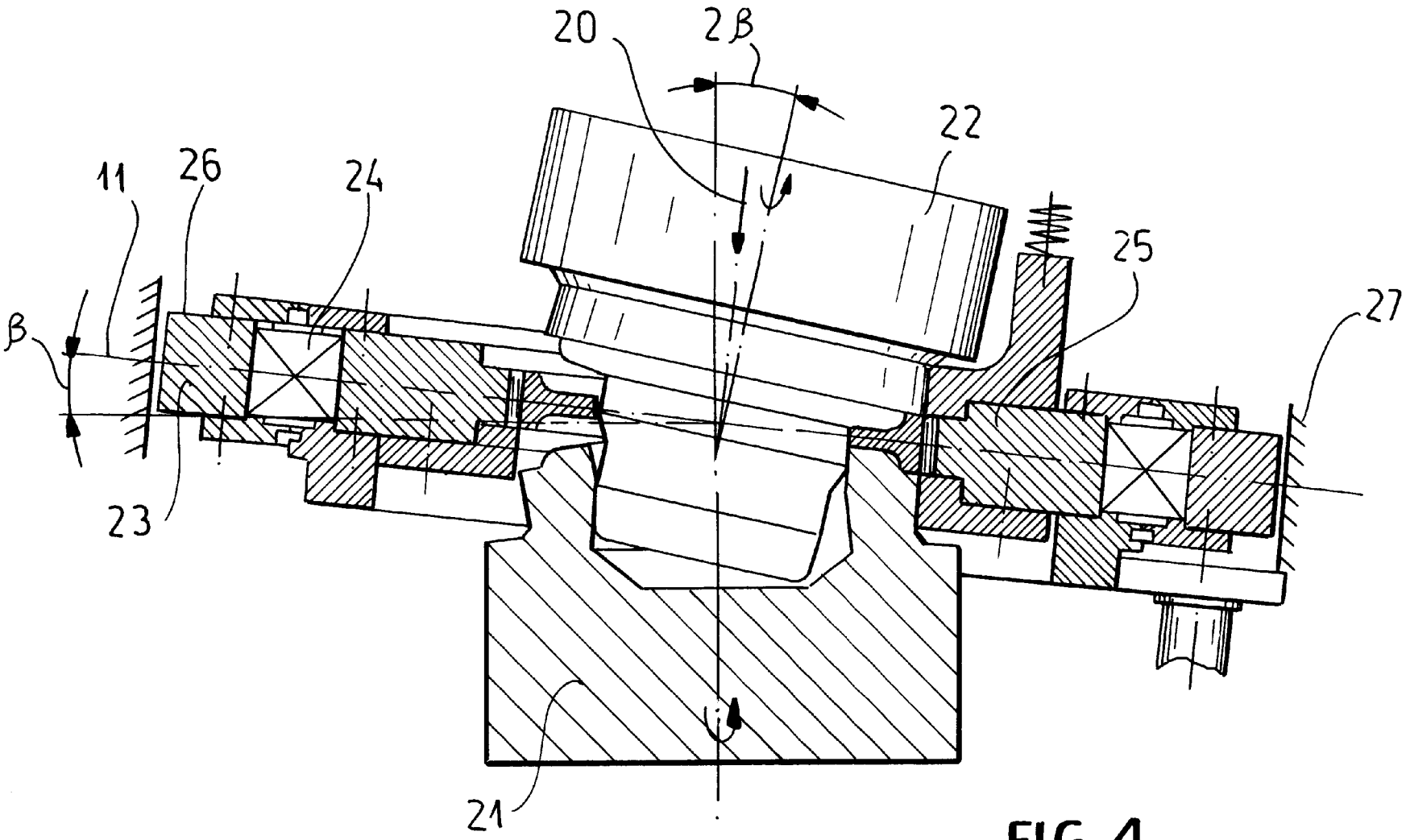
FIG. 4 is a schematic view of a pressing apparatus with one-sided pressing above the upper tool 22.

In FIG. 4 the lower tool 21 is fixed in the pressing direction 20 so that only the upper tool 22 can be pressed inward. To this end the die 25 is mounted to float with the bearing 24 and the bearing ring 23 in a slide 26 in the frame 27.

When the pivot axis of the lower tool 21 is vertical the axial symmetry line 11 is offset by the angle β from the horizontal while the upper tool is angled with its rotation axis at an angle 2β relative to the vertical or β relative to the pressing direction 20. With the method according to the invention the following working steps take place:

1. In the loading station B the die 5 is covered with lubricant and then a blank of the workpiece 10 and the die 5 are fitted together with the blank being, for example, pushed by a hydraulic device.
2. When the support 14 is rotated about its axis 28 by 120°, the die and workpiece are swung on the pivot arm 15 into the pressing station. The clamping device 16 holds the outer end 3 of the pivot arm 15. Before pressing the tools 1 and 2 together the die is accelerated with an auxiliary drive 8 to the rotation speed of the constantly rotating tools. Once the pressing operation is finished and the tools are separated, the clamping device is released and the die is pivoted by the pivot arm through another 120° and simultaneously or subsequently the die is braked.
3. In the unloading station 10 the workpiece 10 is separated from the die by the knock-out device 17 if necessary with angled teeth with simultaneous rotation. Subsequently the device can be cleaned and if necessary cooled before it is again reloaded.

The pressing station according to the invention can be used as shown in the drawing with a generally vertical pressing direction or also in a position tipped 90° thereto.

We claim:

1. A method of forming external teeth on an annular metallic workpiece centered on a workpiece axis, the method comprising the steps of:

fitting the annular metallic workpiece to a die with internally directed teeth to form axially open and radially closed spaces between the workpiece and the die at the teeth;

pressing a pair of closing members axially oppositely against the die and workpiece and thereby axially closing the spaces;

engaging the fitted-together die, closing members, and workpiece between a pair of tools pressable together along a pressing axis generally parallel to the workpiece axis;

thereafter rotating the die, members and workpiece synchronously about the workpiece axis;

rotating the tools about respective tool axes each forming a small acute angle with the workpiece axis while locally compressing the workpiece axially between the tools to deform the workpiece into the spaces; and supporting the die and workpiece in a bearing unit while compressing the workpiece between the tools.

2. The forming method defined in claim 1 wherein the annular metallic workpiece is fitted to the die at a station offset from and not between the tools.

3. The forming method defined in claim 1, further comprising the step of holding the bearing against axial movement while compressing the workpiece between the tools.

4. The forming method defined in claim 1, further comprising the steps while compressing the workpiece between the tools of simultaneously fitting a second annular metallic workpiece to a second die at a loading station offset from the tools; and separating a third annular metallic workpiece from a third die at an unloading station offset from the tools and the loading station.

5. The forming method defined in claim 1 wherein the tools are rotated at the same rate.

6. An apparatus for forming external teeth on an annular metallic workpiece centered on a workpiece axis, the apparatus comprising:

a die with internally directed teeth;

a pair of tools pressable together along a pressing axis;

means for fitting the workpiece into the die and forming axially open spaces between the workpiece and the die at the teeth;

a pair of closing members axially oppositely engageable against the die and axially closing the spaces;

means for engaging the fitted-together die and workpiece between the pair of tools with the pressing axis generally parallel to the workpiece axis;

means for rotating the die and workpiece about the workpiece axis and for rotating the tools about respective tool axes each forming a small acute angle with the workpiece axis while locally compressing the workpiece axially between the tools to deform the workpiece into the spaces; and bearing means supporting the die and workpiece between the tools for rotation about the workpiece axis.

7. The apparatus defined in claim 6, further comprising an arm carrying the bearing means and displaceable between a position with the bearing means between the tools and a position with the bearing means in a station offset from the tools.

8. The apparatus defined in claim 7, further comprising a stationary support pivotally carrying the arm.

9. The apparatus defined in claim 8 wherein the means for fitting the workpiece into the die is offset in a loading station from the tools.

10. The apparatus defined in claim 9, further comprising means at an unloading station offset from the tools and from the loading station for separating the workpiece from the die.

11. The apparatus defined in claim 10 wherein the support is centrally located between the tools, loading station, and unloading station.

12. The apparatus defined in claim 6 wherein one of the tools is formed with an axially projecting pin and the other of the tools is formed with a recess into which the pin engages.

* * * * *